United States Patent [19]

Trifunovic

[11] 4,141,122

[45] Feb. 27, 1979

[54] PROCESS FOR PRODUCING FLUID JET TEASED, FLUFFY, HAIRY YARNS FROM SHORT/MEDIUM STAPLE MULTIFIBER YARNS

[75] Inventor: Alexander L. Trifunovic, Burlington, N.C.

[73] Assignee: Glen Raven Mills, Inc., Glen Raven, N.C.

[21] Appl. No.: 903,922

[22] Filed: May 8, 1978

Related U.S. Application Data

[60] Division of Ser. No. 821,406, Aug. 3, 1977, which is a continuation-in-part of Ser. No. 752,876, Dec. 13, 1976, abandoned.

[51] Int. Cl.[2] ..... D02G 1/16

[52] U.S. Cl. ..... 28/271; 28/273

[58] Field of Search ..... 28/271, 273, 254; 57/34 R, 77.3, 157 F; 302/63

[56] References Cited

FOREIGN PATENT DOCUMENTS

| | | | |
|---|---|---|---|
| 47-12223 | 4/1972 | Japan | 28/254 |
| 1224701 | 3/1971 | United Kingdom | 28/271 |

*Primary Examiner*—Robert Mackey

*Attorney, Agent, or Firm*—Mason, Fenwick & Lawrence

[57] ABSTRACT

A method for producing a novel teased yarn having teased, hairy, fluffy, fuzzed character without loops resembling angora, alpaca and the like yarns from multifiber spun yarns of short to medium staple, wherein the yarn supplied has a yarn twist in a predetermined twist direction and is fed along a feed path through a yarn feed bore of a jet nozzle member to a fluid vortex station and turbulence chamber station defined within a surrounding housing. The jet nozzle member has a jet vortex generating jet passage opening into the yarn feed bore immediately upstream of the turbulence chamber station directing fluid from a pressurized air chamber into the yarn feed bore in a direction to produce a vortex in a direction opposite the predetermined twist direction of the yarn to exert forces tending to open up the fibers of the spun yarn, and the jet nozzle member additionally includes a plurality of turbulance producing jet passages opening into a turbulence chamber immediately downstream from the fluid vortex station to further open and disarrange the fibers to produce the teased yarn effect.

10 Claims, 16 Drawing Figures

Fig-1
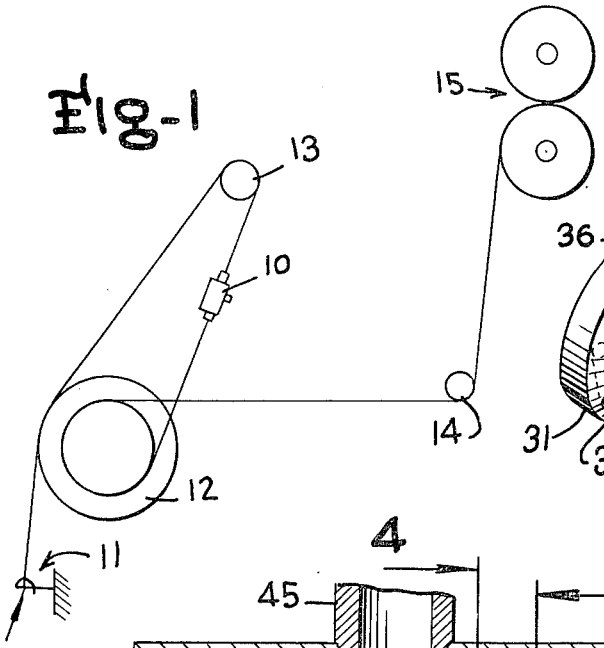
Fig-5
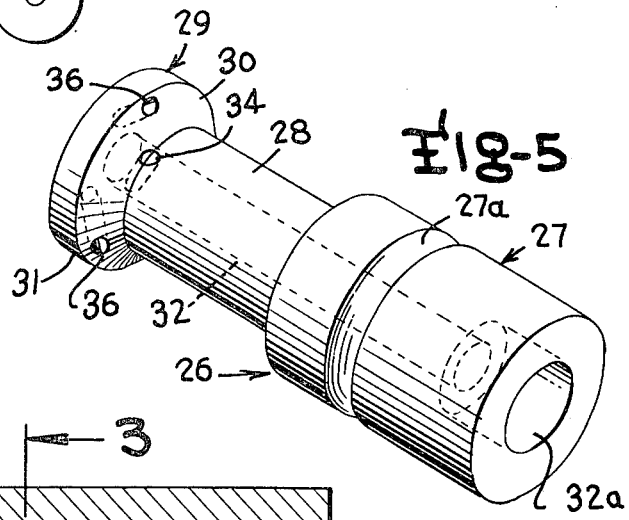
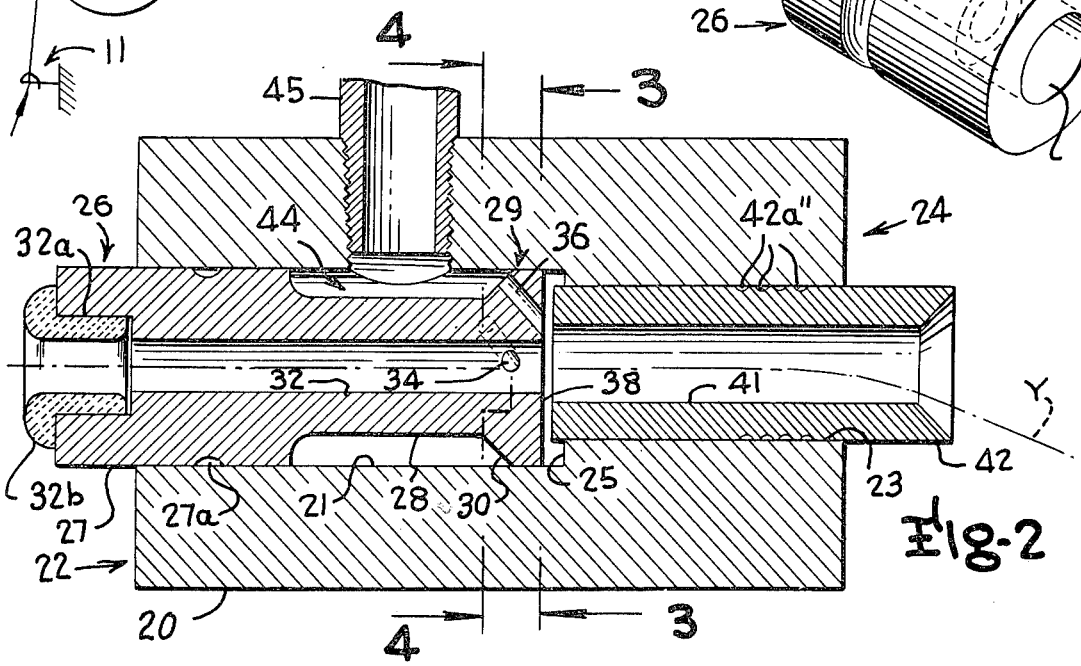
Fig-2
Fig-3
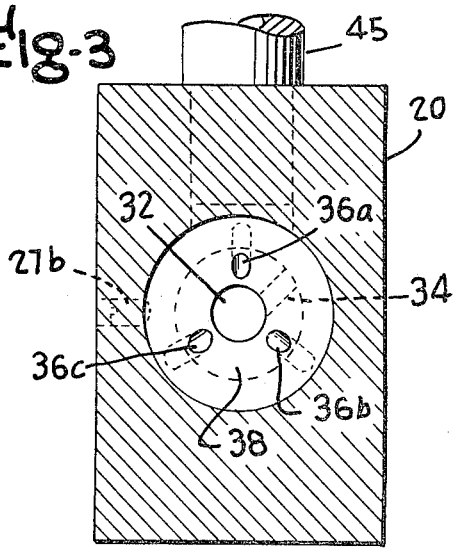
Fig-4
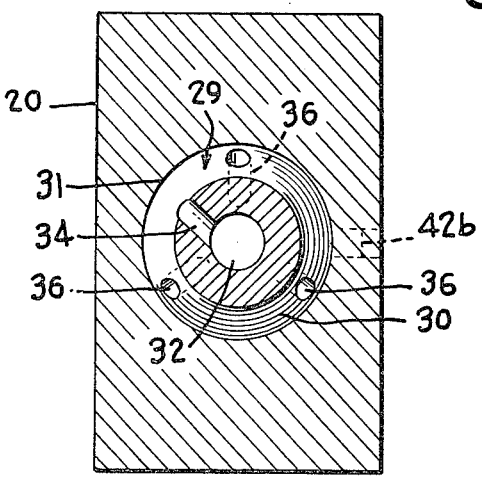

PROCESS FOR PRODUCING FLUID JET TEASED, FLUFFY, HAIRY YARNS FROM SHORT/MEDIUM STAPLE MULTIFIBER YARNS

This application is a continuation-in-part of my earlier patent application Ser. No. 752,876 filed Dec. 13, 1976, now abandoned, and is a division of my earlier patent application Ser. No. 821,406 filed Aug. 3, 1977.

BACKGROUND AND OBJECTS OF THE INVENTION

While my earlier patent application referred to the invention as relating to "bulking" of spun yarns, it is feared that such terminology may be misleading or confusing, since the term "bulking" is commonly understood to relate to processing of continuous filament yarns in a manner producing crimping of the filaments or folding them back and forth on themselves and usually producing many random erratic or irregular loops in the fibers to give greater bulk per unit length to the yarn. My invention is concerned with fluid jet processing of spun yarn formed of short and medium staple fibers, rather than continuous filament yarn, and achieves a fluid teasing or fuzzing of the yarn by spreading and disarranging the fiber ends without any looping effects to produce a novel yarn having what I call a teased effect characterized by a fuzzy, hairy or fluffy appearance resembling long staple yarns of the angora, alpaca, mohair, merino and similar types. The spun yarn when fiber ends are fluid jet teased or exploded outwardly in accordance with the present invention has a volumous hairy character which, when formed into a fabric, provides a fabric with a very pleasing soft hand and fluffy teased character resembling fabrics of angora and similar long staple yarns.

Heretofore, various processes have been used in the textile industry involving subjecting yarn to high velocity fluid jets, generally created by compressed air, designed to have the capability of creating various desired yarn effects. For example, yarns have been subjected to high velocity fluid jets to produce periodic entanglements or interlacings in the yarn to produce a coherent yarn from filaments of multi-filament yarns to improve handling of the yarn in various textile operations and provide properties similar to those produced by conventional true twisting. Fluid jet devices have also been used to produce comingled crimped yarn from synthetic continuous multi-filament yarns providing periodically spaced sites of interfilament comingling providing desired yarn effects, or to provide so-called random slugs of random length and random diameter in yarn or to produce so-called novelty bulked yarns having certain desired properties or appearance.

Many prior patents have heretofore proposed a multitude of arrangements of fluid jets or an annular fluid jet orifice directed toward or encircling a yarn feed path to produce a large number of random erratic loops and whorls in the filaments of continuous multi-filament yarn to produce what has been commonly referred to as "bulking". These, however, in substantially all cases I am aware of, have been proposed for use only with continuous filament yarn, and produce a yarn having a totally different character devoid of the teased, fluffy, fuzzy, non-looped, free fiber end character of the jet teased spun yarn of my invention. Typical of these prior patents is the Breen U.S. Pat. No. 2,783,009 disclosing various fluid jet configurations for achieving bulking of continuous filament yarns. A companion Breen U.S. Pat. No. 2,869,967 mentions the use of those same jet configurations with yarn of conventional spun staple length fibers, but in both cases, the jet configurations disclosed are simply a single jet passage laterally offset from the yarn axis or are annular jet passages encircling the yarn feed path and are expressly recognized as producing a yarn which is bulked by distorting the fibers into a multitude of random erratic loops and whorls, shown in FIGS. 8 and 9 of the latter patent, yielding a yarn which has a markedly different appearance and character from my jet teased spun yarn.

An object of the present invention is the provision of a novel method employing a fluid jet apparatus designed to suck spun yarn of spun short and/or medium staple fibers into an operating zone and subject the yarn to turbulence and vortex action by high pressure fluid streams to produce novel fluid jet teasing, fuzzing or fluffing of spun yarn of single end or plural end or plied types to produce a jet teased yarn of novel character from short and medium staple spun yarn having a unique soft, fluffy, hairy appearance without any loops formed in the fiber ends.

Another object of the present invention is the provision of a novel method employing a fluid jet device for applying to spun yarns the force of jets of compressed air or the like in certain configurations and directions in air streams producing a rotating or vortex action and a turbulent action in serially arranged stations along a yarn processing path to provide a novel jet teased yarn product having a hairy or voluminous look resembling alpaca, angora and similar long staple hairy yarns.

Another object of the present invention is the provision of a novel method for subjecting spun yarns to fluid jet streams in especial arrangement providing both vortex and turbulent effects to produce a novel jet teased yarn which can be used in conjunction with winders or twisters as a continuous process and which is suitable to a wide variety of other textile processing devices.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 1 is a diagrammatic view of a yarn winder and fluid jet yarn teasing device incorporated in a continuous processing line, embodying the present invention;

FIG. 2 is a vertical section view through the yarn teasing fluid jet device constructed in accordance with a first embodiment of the present invention;

FIG. 3 is a transverse section view through the fluid jet yarn teasing device, taken along the line 3—3 of FIG. 2;

FIG. 4 is a transverse section view through the fluid jet device, taken along the line 4—4 of FIG. 2;

FIG. 5 is a perspective view of the nozzle member;

DETAILED DESCRIPTION OF PREFERRED EMBODIMENTS

Figure 6:
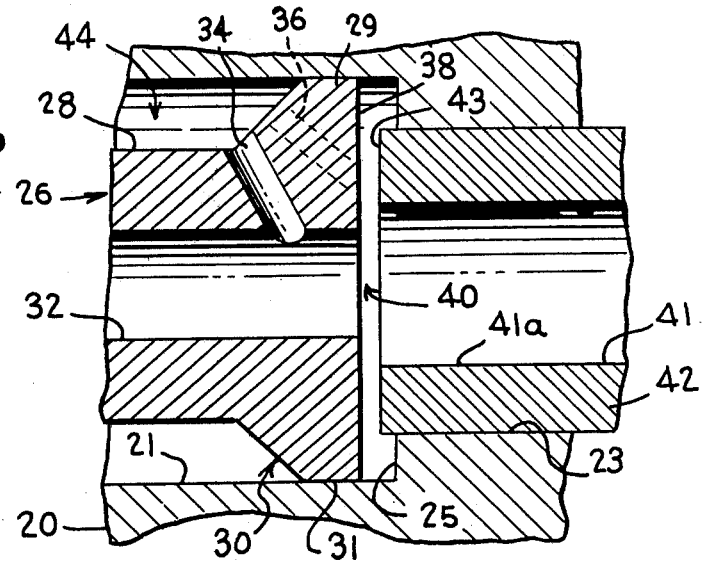
FIG. 6 is an enlarged fragmentary section view of the jet teasing device in the region of the turbulence chamber.

The apparatus and method of the present invention are designed to achieve what I refer to as fluid jet teasing of short and medium staple spun yarns to provide a final product in which the yarn has a hairy, fluffy, fuzzy and voluminous look and a soft hand, to produce a yarn product resembling yarns made from mohair, alpaca, angora, merino and similar fibers which are generally considered as a long staple family of natural fibers. The present invention involves feeding a single end of spun yarn of short and/or medium staple fibers, which may have either an S-twist or a Z-twist, or plural ends of spun yarn into a tube or feed passage into which the yarn is sucked due to negative pressure conditions produced in the interior of the fluid jet teasing device. The yarn is fed through a small cross-sectional cylindrical yarn passage or tube where it is subjected at a first station along the feed path to a rotating or vortex air stream produced by a fluid jet stream directed along an inclined jet axis converging relative to the yarn feed axis toward the direction of travel of the yarn and angled appropriately to cause the air stream to rotate or turn in the opposite direction to the spun yarn twist direction, thus assisting in opening of the spun fibers in the yarn and placing them under control of the jet vortex immediately upstream from the turbulence chamber. The yarn passes from the tube or feed passage into a turbulence chamber at a second processing station immediately adjacent and downstream from the first station where a further fluid jet stream or set of plural jet streams are directed along inclined axes converging toward the yarn feed axis at a larger angle along the direction of travel of the yarn to produce turbulent conditions which further loosen and change the direction of the fiber end portions in the spun yarn, changing the appearance of the yarn due to the outwardly blown fibers to produce the hairy or voluminous looking teased, fluffy yarn product. The yarn then passes into another tube which acts as a damper and noise suppressor, and then passes to the next stage of the textile processing line.

Referring to the drawings, wherein like reference characters designate corresponding parts throughout the several figures, the fluid jet teasing device, indicated generally by the reference character 10, is designed so that it may be readily interposed in a textile processing line along which spun yarn is being fed, for example, in conjunction with a winder or twister, or it may be employed as a separate device on any other suitable textile processing equipment. The fluid jet teasing device 10 of the present invention is illustrated in the herein described embodiment in conjunction with a winder, wherein a single end of spun yarn having either an S-twist or a Z-twist, for example, a medium staple spun yarn having an S-twist, is led to the fluid jet teasing device 10 through a yarn guide 11 from a supply package and fed about overfeed rolls 12, through a plurality of courses or wraps about the overfeed rolls in the usual manner, and then about a guide bar or roll 13 to lead the yarn to the upstream end of the yarn passage in the fluid jet teasing device 10, and the teased, fluffy yarn issuing from the jet teasing device 10 may be directed, for example, about a guide 14 to the winder head 15 to form a wound package of the teased spun yarn.

A preferred embodiment of the fluid jet teasing device for the spun yarn is illustrated in greater detail in FIGS. 2 through 5 and comprises a main body 20, made for example, from steel or other metal, which in the illustrated embodiment may form a housing of rectangular exterior configuration although it will be appreciated that the main body 20 may be a cylindrical tubular member, if desired. The main body 20, in the illustrated example, is provided with a larger diameter cylindrical bore portion 21 extending from the upstream or inlet end 22 of the body 20 to a location slightly downstream of the longitudinal center or mid-region thereof and communicates with a smaller diameter cylindrical bore portion 23 extending to the outlet or downstream end 24 of the main body 20. The larger diameter bore portion 21 joins the smaller diameter bore portion 23 downstream of the mid-region of the body 20 by an annular transition surface or shoulder forming a transition wall 25 lying in a plane perpendicular to the longitudinal center axis of the main body 20 along which the yarn is fed.

The nozzle member 26 supported within the larger diameter bore portion 21 has an enlarged inlet head portion 27 joined to an elongated smaller diameter tunnel portion 28 extending over about half of the length of the nozzle member from the inlet head portion 27 to an enlarged nozzle head portion 29 its downstream end. The nozzle head portion 29 as illustrated in the drawings may be formed of a conical diverging tapered transition portion 30 and a larger diameter head portion 31 closely conforming to the diameter and cross-sectional configuration of the upstream bore portion 21 to bear against the surface of the bore 21 and support the nozzle head portion 29 of the nozzle member 26 adjacent against the transition wall 25. A yarn passage or bore 32 extends through the axial length of the nozzle member 26 and includes, in the illustrated embodiment, an enlarged inlet bore portion **32*a* at its upstream end to receive a porcelain insert eyelet or the like as indicated at 32*b***.

A vortex generating jet passage or orifice 34 extends inwardly to the yarn passage 32 from the base or smallest diameter zone of the tapered head portion 30. The longitudinal center axis of the jet passage 34 is located so as to convergently incline inwardly toward the yarn path and toward the downstream end 24 of the body 20, with the center axis of the vortex jet passage 34 inclined longitudinally relative to the vertical, in the downstream longitudinal direction, or referenced to the vertical longitudinal plane through and including the longitudinal axis of the yarn feed axis through the yarn passage 32, so as to define an angle which I refer to as the forward angle in a range of about 15° to 30°, for example, about 22°. The center axis of the vortex jet passage 34 is also displaced laterally of the diametric longitudinal plane through the center axis of the bore 32 to enter the bore 32 substantially tangentially or is inclined in a lateral or transverse direction forming a small angle referenced to the transverse plane perpendicular to the longitudinal or yarn feed axis, which I refer to as the lateral angle, in an appropriate direction to generate a rotating or vortex air stream rotating in a direction opposite to the spun yarn twist direction. For example, if an S-twist yarn is being fed to the yarn teasing device 10, the jet passage 34 in the nozzle member 26 is arranged to produce a rotating or fluid vortex in the yarn passage 32 which rotates in the Z direction, or if a Z-twist yarn is to be fed to the teasing device 10, the jet pasage 34 of the nozzle member 26 should be arranged to produce a rotating or fluid vortex in the yarn passage 32 which rotates in the S direction. In either case, the direction of the rotating or fluid vortex air stream produced by the jet passage 34 should be in the direction opposite the direction of the twist of the yarn to achieve partial opening of the spun fibers as the yarn passes into the zone of influence of the jet passage 34.

A turbulence generating set of jet passages 36 are provided in the nozzle head 29 slightly downstream from the jet passage 34 opening at their inlet end through the tapered transition surface portion 30 of the head 29 extending between the peripheries of the constricted portion 28 and the larger diameter head portion 31 and opening at their downstream ends through the annular downstream end wall or end face 38 of the head portion of the nozzle member. These turbulence generating jet passages 36 are arranged to direct fluid jet streams into a turbulence chamber 40 formed at the upstream inlet end 41*a* of the yarn passage or bore 41 in the outlet tube member 42 which forms a damper and noise suppressor tube and is adjustably fixed, for example by a set screw, in the smaller diameter bore portion 23 of the main body 20. In the illustrated embodiment, the inlet end portion 41*a* of the yarn passage or bore 41 is of cylindrical configuration and the annular upstream end 43 confronting and closely adjacent to the downstream end face 38 of the nozzle member, and the encircling surface of the bore 21 about the space between the face 38 and end 43 form the bounding surfaces of the turbulence chamber into which the jets from passages 36 issue. The periphery of the outlet tube member 42 in the illustrated embodiment is provided with a plurality of set screw grooves 42*a* 11 at selected axially spaced locations to coact with a set screw 42*b* in the body 20 in holding the tube member 42 at the desired position. The turbulence generating jet passages 36 should have a forward angle, or an angle referenced to the vertical longitudinal plane through the yarn feed axis, which forms a greater angle with the vertical than the forward angle of the vortex generating jet passage 34. These turbulence jet passages 36 may all have the same angles relative to the yarn feed axis, or may be each inclined at a different angle value from the yarn feed axis within a range of between about 15° and 56°. In one example, with three jet passages 36 as provided in the illustrated embodiment, one of the jet passages 36 may be disposed at an angle of 40° converging in the downstream direction, to the yarn feed axis, the second passage 36 may be inclined at an angle of about 42.5° to the yarn feed axis, and the third jet passage may be inclined at an angle of about 36.5° relative to the yarn feed axis. The jet passages 36 are also spaced circumferentially about the head portion having their outlets or downstream ends located, for example, as illustrated in FIG. 3 at 36*a*, 36*b* and 36*c*.

The smaller diameter tunnel portion 28 of the nozzle member 26 defines within the bore 21 of the main body 20 an annular chamber 44 surrounding the tunnel portion 28 to which pressurized fluid, for example, air under pressure of about 20 to 40 pounds per square inch (1.41 to 2.81 kg/cm$^2$) is supplied through an inlet opening 45. The inlet ends of the vortex generating jet passage 34 and the turbulence generating jet passages 36 communicate directly with the annular chamber 44 and thus the pressurized air is formed into air jet streams issuing from the outlet ends of these passages.

In the described embodiment, the inlet head portion 27 of the nozzle member 26 is provided along its outer periphery with an annular set screw groove indicated at 27*a*, near the upstream end of the nozzle member 26 and a set screw 27*b* is provided in the body 20 to extend into the groove 27*a* and releasably lock the nozzle member 26 in place. Thus, the nozzle member 26 may be readily removed for cleaning, repair, or for replacement, for example, to exchange a nozzle member having a vortex generating passage arranged for Z-twist yarn instead of S-twist yarn. Also, other nozzle members shaped like the nozzle member 26 but having different numbers of inclined air passages or air passages which are inclined at different angles may be readily substituted for the nozzle member 26 having the two sets of air passages 34 and 36 as described above, by simply loosening the set screw 27*b* and withdrawing the nozzle member 26 out of the bore 21 and inserting another one.

Figure 7:
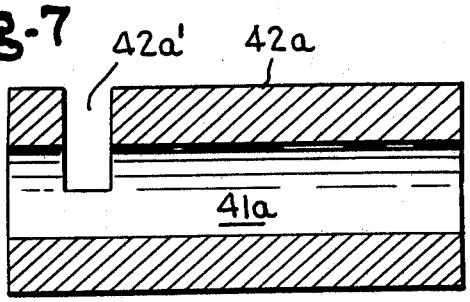
FIGS. 7 through 12 are longitudinal section views of modified forms of outlet tube members which may be used with the jet teasing device.
Figure 10:
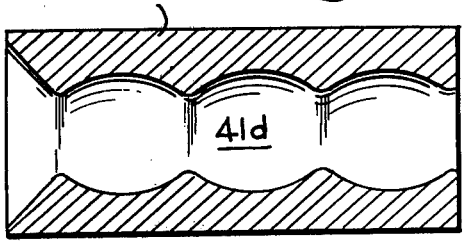

Various configurations may be used for the outlet tube member which provides the damping and noise suppressing effect, providing also slight differences in the teasing, fluffing or fuzzing effects produced by the device. For example, as illustrated in FIG. 7, the outlet tube member 42*a* similar to the outlet tube 42 of FIG. 2 is provided with a semi-cylindrical notch 42*a*′ cut half way through the tube along a transverse plane perpendicular to the tube axis, as shown.

Other useful configurations for the outlet tube member are illustrated in FIGS. 8, 9, 10, 11 and 12. In the forms shown in FIG. 8, the outlet tube member 42*b* has a pair of semi-cylindrical notches 42*b*′ and 42*b*″ cut along parallel transverse planes perpendicular to the tube axis from opposite sides of the tube member and spaced serially along the yarn feed path. In the forms shown in FIGS. 9, 10, 11 and 12, the outlet tube members 42*c*, 42*d*, 42*e*, and 42*f* have a truncated conically flared inlet portion of the yarn passage therethrough. The yarn passages 41*c*, 41*d*, 41*e* and 41*f* of the forms shown in FIGS. 9–12 provide irregular tunnels or passages whose diameters increase and decrease from the upstream end to the downstream end.

Figure 8:
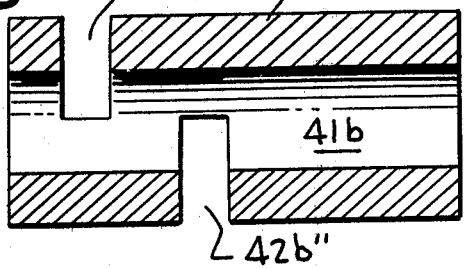
Figure 11:
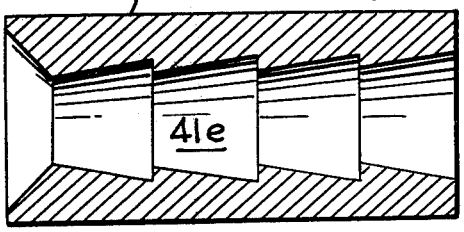
Figure 9:
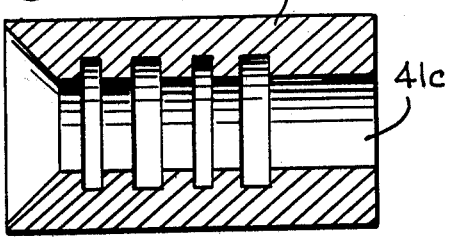
Figure 12:
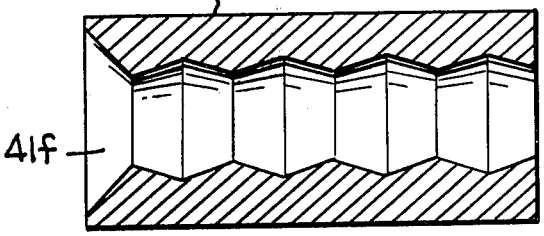

In one satisfactory example, the nozzle member 26 has an overall axial length from the upstream end to the downstream end surface 38 of about 1.625 inches (41.275 mm), the inlet head 27 has an axial length of about 0.881 inches (22.38 mm), with a diameter of about 0.625 inches (15.875 mm), the tunnel portion 28 has a diameter of about 0.437 inches (11.1 mm) and an axial length of about 0.664 inches (16.86 mm), and the larger diameter head portion 31 has a diameter of about 0.625 inches (15.875 mm). The diameter of the yarn passage 32 in this example is about 0.161 inches (4.09 mm), and the conical portion 30 flares outwardly at an angle of about 48° to the yarn feed axis. The diameter of the vortex generating jet passage 34 of this example was about 0.062 inches (1.57 mm), the axis of the jet passage 34 was disposed at a forward angle inclined at about 85° to the yarn feed axis and inclined at a small lateral angle to the diametric plane through the center axis of the yarn passage 32 passing through the exit end of the jet passage 34 and was thus directed to pass to one side or the other of the yarn feed axis in the appropriate direction to impart a clockwise or counterclockwise rotation of the air within the yarn passage 32 in a direction opposite the direction of twist of the yarn, as previously explained. The turbulence generating jet passages 36 of the illustrated embodiment may have diameters in the range from 0.039 inches to 0.062 inches (0.99 mm to 1.57 mm), for example, about 0.062, and the three passages 36 are arranged at angles to the yarn axis of about 47°. The outlet tube member 42 of the illustrated example has an axial length of about 1.375 inches (34.9 mm), an outer diameter of about 0.500 inches (12.7 mm), the bore of the outlet tube member 42 has a diameter of 0.250 inches (6.35 mm) and the upstream end wall of the outlet tube member 42 forming the turbulence chamber 40 with the downstream face 38 of the nozzle member was spaced about 1.5 mm from the face 38 (although this may vary from about 0.5 mm to 10 mm depending on yarn and other parameters). If outlet tubes of the type indicated at 42*a* or 42*b* of FIGS. 7 or 8 are used, the semi-circular slot or slots 42*a'* or 42*b'*, 42*b''* may have a width of about one-eight inch cut in outlet tube members of the same dimensions as those given above for the outlet tube 42 of FIG. 2.

In one specific example wherein the jet bulking device described above produced highly satisfactory results to impart the desired teased, fluffing or fuzzing effects to spun yarns, a yarn input speed of about 200 yards per minute was used with a yarn overfeed of about one percent and with an air pressure of about 40 p.s.i. at 13 c.f.m. The yarn processed in this example was two ends of 6 c.c. (cotton count), 2 inch staple 3 denier bright acrylic yarn having a twist of about 7.3 turns per inch in the Z direction. As a consequence of the pushing apart and distortion and opening up of the fibers produced by the vortex generating jet and the turbulence generating jets, the mechanical fiber distortion in the yarn changed the original yarn count from about 6/2 c.c. to about 4.8/2 c.c.

Other examples of yarns which have been processed with the above described jet teasing device and yarn speed and pressure parameters, resulting in highly satisfactory teasing, fluffing or fuzzing of the yarn without producing loops in the fibers, are 2 ends of 2 inch staple, 3 denier TRILOBAL bright acrylic spun yarn and 2 inch staple, 3 denier acrylic type spun yarn, made on a modified cottom system. One can process any bright or semi-dull acrylic yarn as well as nylon or polyester yarn in this manner through the jet teasing device, either as single end or plural end spun yarn, with worsted counts in the range of 7 to 12, with a range of overfeed from 0 to about 10% and air pressures in the range of about 30–50 p.s.i. and air consumption in the range of about 8 to 18 c.f.m. and obtain the desired non-looped teased or fuzzed fiber end character in the resultant yarn.

In another example, 2 ends of 9 worsted count yarn, made from 2 inch staple, 3 denier acrylic yarn, was processed by a jet teasing device like the above described example, but having a vortex generating jet passage of 0.052 inches diameter and jet passages 34 of 0.040 inches diameter, supplied with air at 40 p.s.i. and 8 c.f.m., to save air consumption, and highly satisfactory fiber teasing or fuzzing without loop formation was attained.

It has been found during processing of the spun yarn through the jet teasing device with various yarn speeds, that increasing of the yarn speed beyond, for example, about 150 yards per minute to 200 yards per minute with the same air pressure results in a decrease in the hairiness, fluffiness or teased effect in the yarn, while decreasing yarn speed with the same air pressure results in increasing the hairiness or teased effect. For example, a decrease of yarn speed to about 120 yards per minute with air pressure of about 40 p.s.i. or in the range 30 to 40 p.s.i. results in tremendous hairiness of the processed spun yarn, such that this amount of hairiness may be seriously disadvantageous for certain applications, such as for the sweater market, although this considerably greater hairiness provides a yarn which could have significant advantages for use in the glove industry, blanket weaving, and similar applications. While in most examples, I have used yarn speeds of about 150 yards per minute to 200 yards per minute with air pressures in the 30 to 40 p.s.i. range, or up to a maximum of 50 p.s.i. yarn speeds for spun yarns may be increased up to about 500 yards per minute depending on the yarn type and on the degree of hairiness or fuzziness desired. My fluid jet teasing apparatus and process achieves significant teasing or fuzzing up of the yarn by teasing out or exploding the ends of the fibers for spun yarns with short to medium staple lengths of, for example, 1½ inches to 2 inches, especially for yarns having minimum staple of approximately 1.5 inches, wherein the yarn is increased in volume by becoming hairier, the yarn is made significantly softer and fluffier, especially when dyed yarn is teased in this manner, and produces an extremely desirable and advantageous soft hand in the yarn or fabric form, without forming any loops or crunodal loops in the fibers or yarn ends, but providing only straight loose ends which make the yarn resemble a cashmere or angora yarn. The fluid jet teases a meager or standard size yarn by spreading and enlarging loose fibers and changing entirely its looks and properties so that from a "smooth yarn", the spun yarn is changed to a novel yarn resembling angora or alpaca type yarn which would be far more expensive and hard to make. The yarn as processed through this fluid jet teasing apparatus becomes thicker so that less amount of weight can be used than when using unprocessed yarn for a fabric, and a particularly dramatic change is made in dyed yarns when run through the fluid jet, as dyed yarns, particularly of the polyester, acrylic, rayon, nylon and cotton type and blends thereof in whatever percentages, are to a more or less degree stiff and flat due to the dyeing process, and the processing through the fluid teasing jet changes the properties of the yarn drastically to become a soft and fluffy yarn which is highly desirable for sweaters and fabrics having a soft hand or fuzzy or hairy character. The jet teasing apparatus can be used to process single end spun yarn of short to medium staple as well as dual end yarns, and has been found to produce desirable hairiness or teasing of untwisted yarns as well as the conventional twisted spun yarn.

Figure 14:
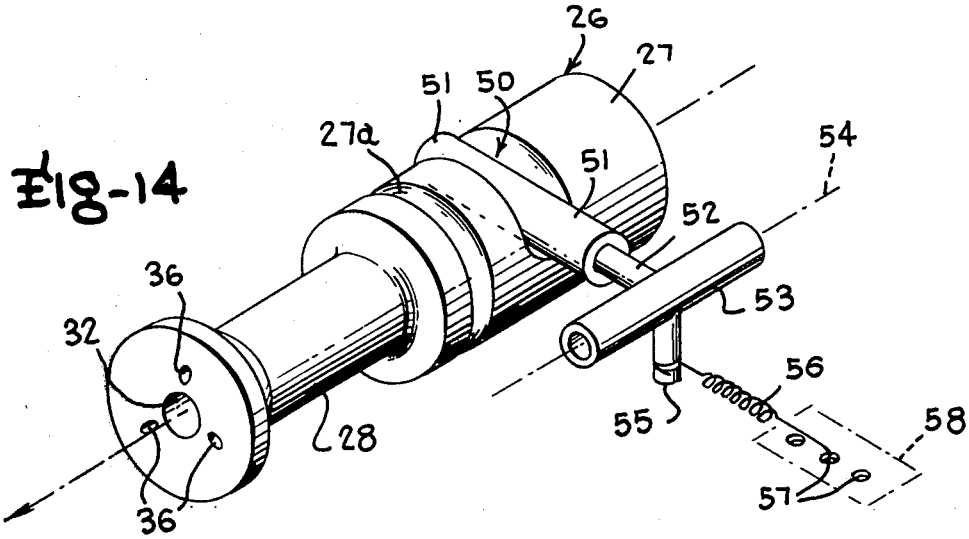
FIG. 14 is a perspective view of a modified nozzle member having a fluid and twist deflector bar associated therewith.

FIG. 14 illustrates in perspective form a modification of the jet teasing device to provide a fluid and twist deflector in the region of the yarn passage through the nozzle member 26 between the vortex generating air passage 34 and the yarn inlet eyelet 32*b*. The surrounding housing 20 is not illustrated in this figure to facilitate understanding of the fluid and twist deflector mechanism. In the modification shown in FIG. 14, the components corresponding to those described in the previous embodiment are indicated by the same reference characters as previously used. In this FIG. 14 modification, a substantially semi-circular or semi-cylindrical notch or cut-out 50 is provided in the upstream enlarged inlet cylindrical head portion 27 of the nozzle member 26 between the set screw groove 27*a* therefor and the inlet eyelet 32*b*, which extends substantially to the center line of the yarn passage 32, and receives a pressure bar 51 therein extending across the notch 50. The pressure bar 51 is a cylindrical rod member of rigid material fixed on an arm 52 and extends from a pivot sleeve or tube 53 pivotally supported on a pivot pin 54 fixed to a stationary support, such as the main body or housing 20. The pivot tube 53 has an extension in the form of an elongated lug 55 rigidly extending therefrom at a predetermined angle, for example, at right angles, to the arm 52 and pressure bar 51, and is resiliently biased in a counterclockwise direction, viewed from the downstream end 24 of the housing, by a coil spring 56 coupled at one end to the lug 55 and connected, as by a hook-shaped formation, at the other end inserted in any of a plurality of adjustment holes 57 in a stationary bracket or wall portion, shown in broken lines at 58, to vary the amount of spring force urging the pressure bar into the notch 50. The effect of the pressure bar 51 extending with selectively adjusted spring force into the yarn passage 32 between the upstream end of the yarn passage and the outlet of the vortex generating passage or jet 34 is to provide a fluid restriction in the zone between the inlet end of the yarn passage and the vortex generating hole 34 and also bear against the yarn passing through the passage 32 to serve as a false twist holder to prevent twist generated by the vortex jet from migrating back along the yarn being fed to the inlet eyelet **32*b* and yarn passage 32**.

Figure 15:
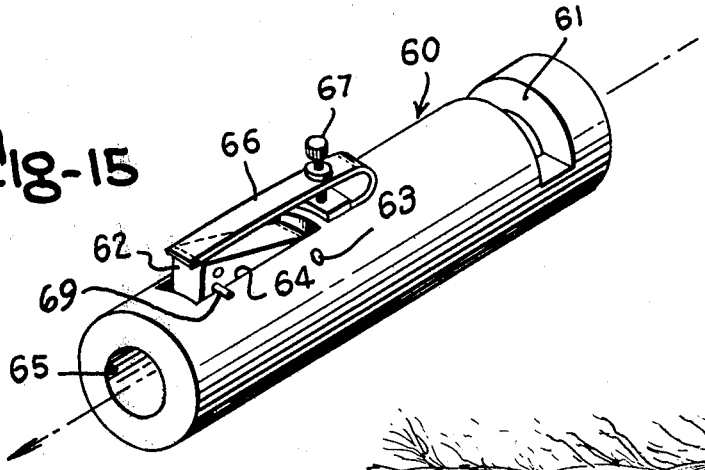
FIGS. 15 and 16 are perspective and longitudinal section views of a modified outlet tube member with adjustable air flow restrictor mechanism.
Figure 13:
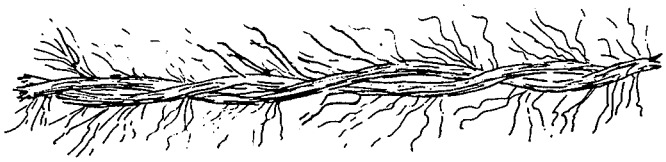
FIG. 13 is a side view of the teased yarn produced by the jet teasing device.
Figure 16:
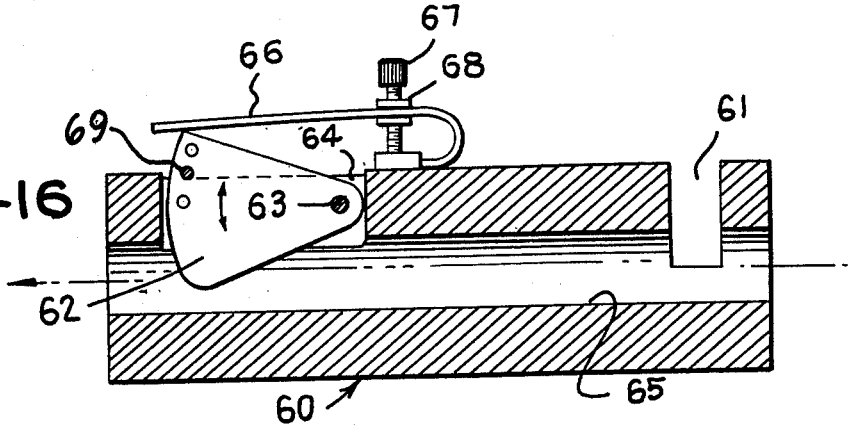

Another variation in the jet teasing apparatus involving a modification of the construction of the outlet tube member is illustrated in the perspective view of FIG. 15 and the longitudinal section view of FIG. 16, wherein the outlet tube member, here indicated by the reference character 60, designed to be mounted in the smaller diameter bore portion 23 of the main body 20, is provided with a semi-cylindrical notch 61 extending substantially halfway through the tube member along a transverse plane, similar to the notch **42*a*' of the FIG. 7 version, and a pivoted air flow restrictor member or fluid breaker 62 in the form of a sector shaped shoe pivoted at 63 in a slot 64 formed in the side wall of the tube member 60 serves as a barrier against outcoming fluid near the exit or discharge end of the passage 65 through the tube member 60. An adjustable pressure spring, in the form of a leaf spring, indicated at 66 has a free end portion which bears against a corner of the sector shaped fluid breaker member 62 protruding externally of the tube member 60 through the slot 64, and the spring 66 is anchored at its opposite end of the exterior surface of the tube member 60 and is adjusted by means of an adjustment screw 67 extending through a threaded collar 68 fixed in a hole in the spring 66 to adjust the resilient pressure applied to the end portion of the fluid breaker 62 remote from its pivot 63. The shoe or breaker member 62 has an adjustable limit stop including a plurality of holes near its curved end into one of which a stop pin 69 may be inserted to abut the edge of the slot 64 and limit the amount of penetration of the shoe into the passage 65**. This fluid breaker, in addition to acting as a barrier against outcoming fluid, to some degree, holds back and keeps loose the yarn within the chamber, increasing in this way the fluid effectiveness to fuzz up or tease the yarn, and thus achieve more effective pulling out of the fiber ends from the yarn body.

What I claim is:

1. A process for fluid jet teasing of short to medium staple multifiber spun yarn being fed along a feed path and having a twist imparted to the fibers in a predetermined twist direction to produce a yarn having teased, hairy, fluffy, fuzzed character without loops resembling angora, alpaca and the like yarns, comprising the steps of feeding the spun yarn with an overfeed through a rectilinear yarn feed inlet passage of a predetermined diameter concentric with a yarn feed axis to direct the path of the yarn along the yarn feed axis through the inlet passage, feeding the yarn from said inlet passage directly into a turbulence chamber concentric with the feed axis and having a maximum diameter greater than the yarn feed inlet passage diameter, directing a continuous jet of air under superatmospheric source pressure through an exit orifice located in said inlet passage immediately upstream of said turbulence chamber and directed to cause fluid vortex conditions in said inlet passage producing rotating forces about the yarn axis in a direction opposite the twist direction of the spun yarn to tend to open up the fibers of the twisted spun yarn, and directing continuous jets of air under superatmospheric source pressure into the turbulence chamber through exit orifices located in an upstream boundary surface of the turbulence chamber located at plural circumferentially spaced positions outwardly of said inlet passage about the yarn feed axis and spaced radially inwardly from the largest diameter portion of the turbulence chamber to impinge on the yarn being fed therethrough, and feeding the yarn from said turbulence chamber through a rectilinear yarn feed outlet passage concentric with the yarn feed axis and the extended center axis of said inlet passage to tease the end portions of the fibers outwardly from the center of the yarn without formation of loops and impart the teased, hairy, fluffy, fuzzed character to the yarn.

2. A process for fluid jet teasing of spun yarn as defined in claim 1, wherein the yarn is fed through said inlet passage at a yarn speed in the range of about 150 to 200 yards per minute.

3. A process for fluid jet teasing of spun yarn as defined in claim 1, wherein said turbulence chamber has upstream and downstream boundary surfaces of flat annular configuration outwardly surrounding the adjacent ends of said inlet and outlet passages and lying in parallel planes perpendicular to the feed axis.

4. A process for fluid jet teasing of spun yarn as defined in claim 1, wherein the air supplied to said exit orifices is under superatmospheric source pressure in the range of about 30 to 50 p.s.i.

5. A process for fluid jet teasing of spun yarn as defined in claim 4, wherein the yarn is fed through said inlet passage at a yarn speed in the range of about 150 to 200 yards per minute.

6. A process for fluid jet teasing of spun yarn as defined in claim 4, wherein said turbulence chamber has upstream and downstream boundary surfaces of flat annular configuration outwardly surrounding the adjacent ends of said inlet and outlet passages and lying in parallel planes perpendicular to the feed axis and spaced apart a distance less than the diameter of said inlet passage.

7. A process for fluid jet teasing of spun yarn as defined in claim 4, wherein said turbulence chamber has upstream and downstream boundary surfaces of flat annular configuration outwardly surrounding the adjacent ends of said inlet and outlet passages and lying in parallel planes perpendicular to the feed axis.

8. A process for fluid jet teasing of short to medium staple multifiber spun yarn being fed along a feed path and having a twist imparted to the fibers in a predetermined twist direction to produce a yarn having teasd, hairy, fluffy, fuzzed character without loops resembling angora, alpaca and the like yarns, comprising the steps of feeding the multifiber spun yarn having the predetermined twist imparted thereto with an overfeed through a rectilinear yarn feed inlet passage of a predetermined diameter concentric with a yarn feed axis to direct the path of the yarn along the yarn feed axis through the inlet passage, feeding the yarn from said inlet passage directly into a turbulence chamber concentric with the feed axis and having a maximum diameter greater than the yarn feed inlet passage diameter, directing a continuous jet of air under superatmospheric source pressure through an exit orifice located in said inlet passage immediately upstream of said turbulence chamber and directed to cause fluid vortex conditions in said inlet passage producing rotating forces about the yarn axis in a predetermined direction to tend to open up the fibers of the spun yarn and place the yarn under fluid vortex control at the entrance of the turbulence chamber, and directing continuous jets of air under superatmospheric source pressure into the turbulence chamber through exit orifices located in an upstream boundary surface of the turbulence chamber located at plural circumferentially spaced positions outwardly of said inlet passage about the yarn feed axis and spaced radially inwardly from the largest diameter portion of the turbulence chamber to impinge on the yarn being fed therethrough, and feeding the yarn from said turbulence chamber through a rectilinear yarn feed outlet passage concentric with the yarn feed axis and the extended center axis of said inlet passage to tease the end portions of the fibers outwardly from the center of the yarn without formation of loops and inpart the teased, hairy, fluffy, fuzzed character to the yarn.

9. A process for fluid jet teasing of spun yarn as defined in claim 8, wherein the air supplied to said exit orifices is under superatmospheric source pressure in the range of about 30 to 50 p.s.i.

10. A process for fluid jet teasing of spun yarn as defined in claim 8, wherein the yarn is fed through said inlet passage at a yarn speed in the range of about 150 to 200 yards per minute.

* * * * *